United States Patent [19]

Magnusson

[11] Patent Number: 4,865,095

[45] Date of Patent: Sep. 12, 1989

[54] TOOL FOR ROTATION RING TYPE BARKING MACHINES

[75] Inventor: Lennart Magnusson, Iggesund, Sweden

[73] Assignee: Mecania AB, Hudiksvall, Sweden

[21] Appl. No.: 263,346

[22] Filed: Oct. 27, 1988

[30] Foreign Application Priority Data

Jun. 8, 1988 [SE] Sweden ..... 8802140

[51] Int. Cl.[4] ..... B27L 1/00

[52] U.S. Cl. ..... 144/208 E; 144/241; 144/340

[58] Field of Search ..... 144/208 R, 208 E, 241

[56] References Cited

U.S. PATENT DOCUMENTS

| | | | |
|---|---|---|---|
| 3,709,272 | 1/1973 | Bowers | 144/241 |
| 3,973,607 | 8/1976 | Jonsson | 144/241 |
| 4,280,541 | 7/1981 | Reimler et al. | 144/208 E |
| 4,438,794 | 3/1984 | Carpenter et al. | 144/208 E |
| 4,653,559 | 3/1987 | Ackerman | 144/241 |

FOREIGN PATENT DOCUMENTS 41507 8/1980 Sweden .

*Primary Examiner*—W. Donald Bray

*Attorney, Agent, or Firm*—McFadden, Fincham, Marcus & Allen

[57] ABSTRACT

A tool for rotation ring type barking machines comprises a curved swinging arm which is adapted to carry at a first, free end a cutting edge and which is detachably connected at its opposite end by means of a screw connection with a shaft rotatably mounted in the rotor of the machine, more particularly via a holder which is preferably made in one piece with the shaft and extends at an angle relative to said shaft. The swinging arm is displaceably movable relative to the holder and fixable by means of said screw connection in different selectable positions relative thereto, in order to permit variation of the distance between the center of the pivot shaft and the center of gravity of the swinging arm.

7 Claims, 2 Drawing Sheets

11
10'
18'
18
15
15'
T
9
6'
α
13
14
6"
C

TOOL FOR ROTATION RING TYPE BARKING MACHINES

TECHNICAL FIELD OF THE INVENTION

The present invention relates to a tool for rotation ring type barking machines, comprising a curved swinging arm which is adapted to carry at a first, free end a cutting edge and which is detachably connected at its opposite end by means of a screw connection with a shaft rotatably mounted in the rotor of the machine, more particularly via a holder which is preferably made in one piece with the shaft and extends at an angle relative to said shaft.

BACKGROUND OF THE INVENTION

Barking machines of the above-mentioned type basically operate in such a manner that the individual log is fed lengthwise by means of rolls through the hollow space of an annular rotor on which a number of edge-carrying tools or swinging arms are hingedly mounted, at the same time as the rotor is caused to rotate, the tools and the cutting edges thereon being yieldably urged against the circumference of the log by means of suitable spring means enabling the cutting edges to follow any irregularities of the log surface. In these machines, logs of greatly varying thicknesses are worked, from slender stocks less than 100 mm in diameter to heavy saw timber with diameters in excess of 300 mm. In order to avoid that the swingable tools have to travel an unnecessarily long distance between the initial position which they assume during the periods between working of successive logs and the active position on the surface of a heavy log, the tools are adjustable in different initial positions by means of movable stops built into the rotor and limiting and determining the angle to which the spring means can swing the arms inwardly toward the center of the rotor, more particularly in such a manner that the tools in their initial positions are held swung-in with their cutting edges close to the center during working of an assortment of slender logs, whereas they are swung farther away from the center in the initial position for the working of thicker logs. In this manner, the tools need not climb an unnecesarily long distance over the log ends from the initial position to the active position during barking of heavy timber.

During operation, when the rotor of the machine rotates at maximum speed to give maximum barking capacity, the force by which the spring means strive to urge the tool cutting edges against the log circumference is counteracted by the centrifugal force exerted upon the tools by the rotation of the rotor. Naturally, the centrifugal force increases according as the rotor speed is increased. Furthermore, the pressure of the cutting edges upon the log is influenced by the positions of the centers of gravity of the tool arms relative to the associated pivot shafts, such that an increasing distance between the pivot shaft and the center of gravity exerts an increasing outwardly swinging torque on the swinging arms and thus a decreasing contact pressure of the cutting edges. In view hereof, if heavy logs are worked at high speeds, the contact pressure of the spring means may be counteracted to such an extent that the barking efficiency deteriorates.

BRIEF DESCRIPTION OF THE INVENTIVE CONCEPT

The present invention aims at obviating the above-mentioned disadvantage and at providing a barking tool which gives excellent barking results also on heavy logs at high rotor speeds. According to the principal feature of the invention, this is achieved in that the swinging arm is displaceably movable relative to the holder and fixable by means of said screw connection in different selectable positions relative thereto, in order to permit variation of the distance between the center of the pivot shaft and the center of gravity of the swinging arm.

On the tool according to the invention, the swinging arm can thus be adjusted in a position maximally extended away from the holder, in which position the cutting edge lies close to the rotor center during working of slender logs, and adjusted in a position retracted against the shaft, in which position the cutting edge has been removed from the rotor center for barking thicker logs, the center of gravity of the swinging arm in the last instance being localised closer to the shaft than in the first instance, while minimising the torque exerted by the weight of the swinging arm and counteracting the contact pressure of said spring means.

BRIEF DESCRIPTION OF THE ACCOMPANYING DRAWINGS

In the drawings

DETAILED DESCRIPTION OF A PREFERRED EMBODIMENT OF THE INVENTION

Figure 1:
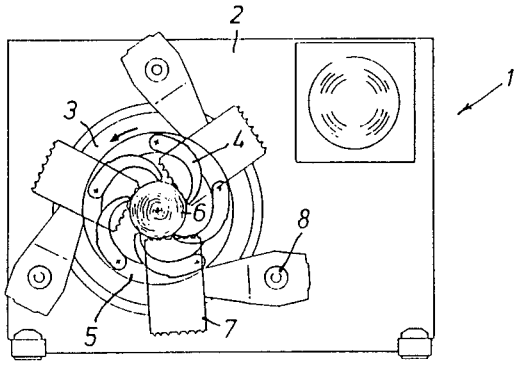
FIG. 1 is a schematic front view of a rotation ring type barking machine.
Figure 5:
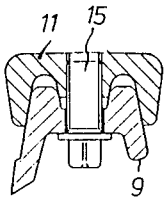
FIG. 5 is a cross-sectional view of the tool in the assembled state.

Reference numeral 1 in FIG. 1 generally designates a barking machine which includes, besides a supporting frame or housing 2, a rotor 3 on which a number of tools 4 according to the invention are mounted. The embodiment illustrated comprises five tools, but this number may vary. In actual practice, many machines are equipped with six such tools. The rotor 3 is annular, and through the hollow space 5 thereof a log 6 can be fed lengthwise by means of a suitable number of rotating rolls 7, for example three rolls which preferably are in the form of jagged rolls pivotally mounted in journals 8. It is pointed out that the jagged rolls 7 are distinctly separate from the rotor 3 in a direction perpendicular to the plane of the drawing so that the rolls will not come into contact with the rotor. It is also pointed out that a corresponding set of feed rolls are mounted on the rear side of the housing 2, such that a log can be fed before a log end has entered into contact with the tools, or discharged after a log end has lost contact with the tools.

Figure 2:
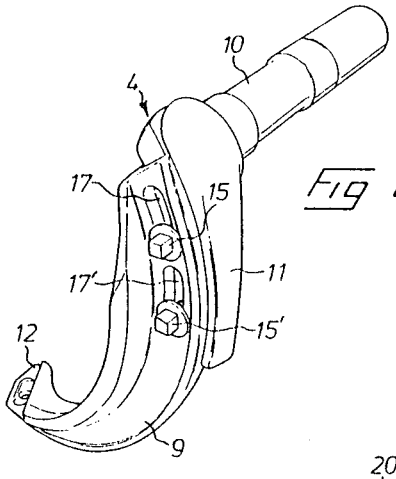
FIG. 2 is an enlarged perspective view of a tool according to the invention, included in the machine.
Figure 4:
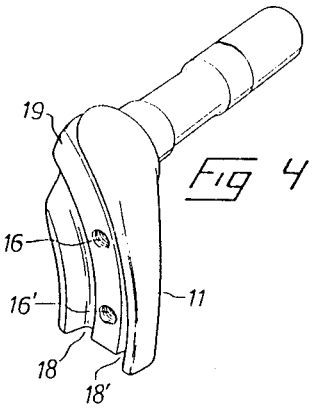
FIG. 4 is a perspective view of a pivot shaft included in the tool, and the holder associated therewith.
Figure 3:
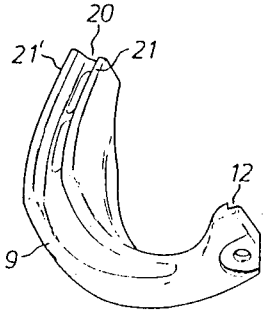
FIG. 3 is a perspective view of a swinging arm included in the tool as shown in FIG. 2.
Figure 6:
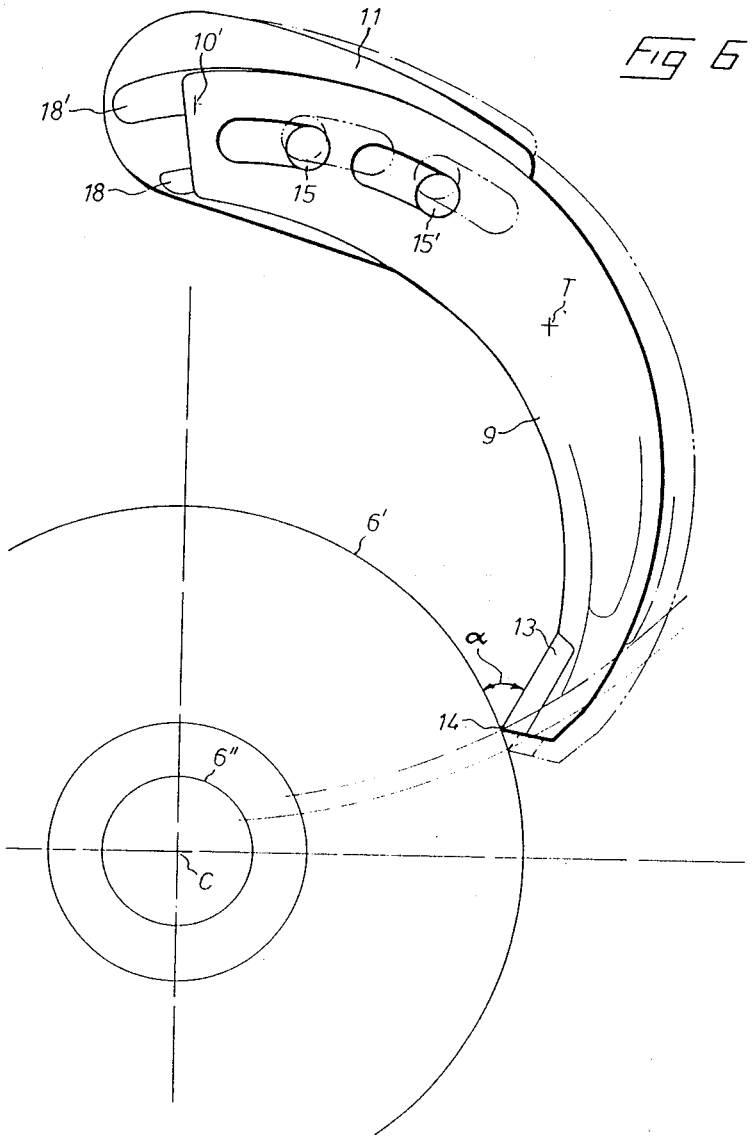
FIG. 6 is an enlarged view showing the tool during working of a log.

The tool illustrated in FIGS. 2–4 comprises the actual swinging arm 9 and a shaft 10 which is journaled in the rotor 3 and which at its end protruding from the rotor has a holder 11. The holder 11 preferably is formed in one piece with the shaft 10, but may also be designed as a separate part which subsequently is firmly connected with the shaft 10. The swinging arm 9 is curved and has at its free end remote from the holder 11 a seat 12 adapted to accommodate a detachable cutting tool (not shown) which incorporates the cutting edge performing the actual barking operation. Such a cutting tool is shown in FIG. 6 where it is designated 13. The cutting edge proper of the tool is designated 14.

As will appear from FIGS. 2–5, the swinging arm 9 is detachably connected with the holder 11 via a screw connection which, in the embodiment illustrated, comprises two screws 15, 15' which are in engagement with threaded holes 16, 16' in the holder 11 and extend through oblong holes 17, 17' in the arm 9. The holder 11 is formed with two elongated circularly curved grooves 18, 18' spaced apart by an intermediate ridge 19 in which the threaded holes 16, 16' are drilled. These grooves are adapted to receive two beads 21, 21' formed on the swinging arm 9 and spaced apart by an intermediate recess 20. Besides being oblong, the holes 17, 17' for the screws 15, 15' are also curved with a radius of curvature, the center of which coincides with that of the circular grooves 18, 18' and the beads 21, 21', respectively. This means that the swinging arm 9, after detachment of the screws 15, 15' can be displaced relative to the holder 11 into an optionally selectable position between two end positions determined by the length of the holes 17, 17', whereupon the arm can be fixed in the desired position by tightening the screws 15, 15'. In this manner, the distance between the center of the pivot shaft 10 and the center of gravity of the swinging arm 9 can be varied such that the center of gravity is maximally approached to the center of the shaft 10 in the position shown in FIG. 2 and can be removed from said center by displacement of the arm in a direction outwardly from the holder toward the opposite end position.

In FIG. 6, the tool is assumed to work a relatively thick log 6'. In this case, the arm 9 has been pushed into its inner end position relative to the holder 11, whereby a minimum distance is obtained between the center of gravity T of the swinging arm and a straight line between the rotor center C and the shaft center 10'. In this position, the cutting tool 13 operates at a practically ideal angle of attack between the cutting tool 13 and the log circumference. It should be noted that this angle of attack is a negative one, whereby the cutting tool will remove the bark layer by shearing rather than by cutting.

If the tool is to work a log 6'' having an extremely small diameter, the swinging arm is set to the position shown by dash-dot lines, in which the arm has been maximally removed or projected from the holder 11. In this position, the tool 13 can reach the log while maintaining an acceptable angle of attack and efficiently work the slender log.

CONCEIVABLE MODIFICATIONS OF THE INVENTION

It will be appreciated that the invention is not restricted to the embodiment described above and illustrated in the drawings. For example, it is possible to form the bark-working cutting edge directly on the swinging arm proper, instead of on an exchangeable separate cutting tool. Furthermore, it is possible to use but one screw in the screw connection, although at least two screws are preferred in actual practice.

What I claim and desire to secure by Letters Patent is:

1. In a tool for a rotation ring-type barking machine comprising: a curved arm having a pair of ends, a holder for said arm, one end of said arm being detachably connected to said holder, a rotatable shaft, said holder being connected to said rotatable shaft; said rotatable shaft being adapted to be mounted to a rotor of said machine; said other end of said arm being adapted to mount a cutting member, the improvement wherein said curved arm is adjustably mounted relative to said holder, and wherein said tool includes means for adjustably mounting said curved arm to said holder whereby said curved arm may be selectably positioned relative to said holder to permit variation of the distance between the center of said shaft and the center of gravity of said curved arm.

2. A tool as claimed in claim 1, wherein said means for releasably connecting said curved arm to said holder comprises a threadable means adapted to threadably engage said holder, and said curved arm having at least one oblong slot therein whereby said threadable means is adapted to extend through said oblong slot.

3. A tool as claimed in claim 2, wherein said oblong slot comprises a curved slot in said arm, said arm having at least one curved projection associated therewith, said holder having a correspondingly curved guide means comprising at least one curved groove whereby said projection of said arm is engagable with said groove of said guide means wherein said guide means is adapted to assist in securing said arm to said holder.

4. A tool as claimed in claim 1, wherein said holder for said curved arm and said rotatable shaft are a one piece member, said holder being angularly disposed relative to said shaft.

5. A tool as claimed in claim 1, wherein said curved arm is adapted to be releasably mounted at different positions on said holder to vary the distance between the center of said rotatable shaft and the center of gravity of said curved arm.

6. A tool as claimed in claim 3, wherein said curved arm is affixed to said holder by at least one releasable connector

7. A tool as claimed in claim 5, said tool including a cutting member mounted to said other end of said arm.

* * * * *